United States Patent [19]

Connolly

[11] Patent Number: 4,947,496

[45] Date of Patent: Aug. 14, 1990

[54] THERAPEUTIC BED

[75] Inventor: Patrick J. Connolly, Athlone, Ireland

[73] Assignee: Ethos Medical Research Limited, Limerick, Ireland

[21] Appl. No.: 264,973

[22] Filed: Oct. 31, 1988

[30] Foreign Application Priority Data

Nov. 2, 1987 [IE] Ireland ..... 2950/87

[51] Int. Cl.[5] ..... A61G 7/008; A61G 7/015; A47C 21/08

[52] U.S. Cl. ..... 5/61; 5/72; 5/66; 5/430; 128/49

[58] Field of Search ..... 5/61, 430, 60, 66–68, 5/72; 128/49; 269/328

[56] References Cited

U.S. PATENT DOCUMENTS

| | | | |
|---|---|---|---|
| 3,434,165 | 3/1969 | Keane | 5/61 |
| 3,604,024 | 9/1971 | Polanski | 297/425 |
| 3,614,795 | 10/1971 | Agnew . | |
| 4,186,456 | 2/1980 | Huempfner | 5/430 |
| 4,509,217 | 4/1985 | Therrien | 5/430 |
| 4,589,151 | 5/1986 | Behrens | 5/66 |
| 4,653,129 | 3/1987 | Kuck et al. | 5/430 |
| 4,658,450 | 4/1987 | Thompson | 5/61 |
| 4,763,643 | 8/1988 | Vrzalik | 5/61 |

FOREIGN PATENT DOCUMENTS

| | | | |
|---|---|---|---|
| 1059100 | 2/1967 | United Kingdom | 5/61 |

*Primary Examiner*—Alexander Grosz

*Attorney, Agent, or Firm*—Fleit, Jacobson, Cohn, Price, Holman & Stern

[57] ABSTRACT

A therapeutic bed (1) comprises a patient support platform (2) rotatably mounted on a base frame (5). A pair of side members (30) extend longitudinally of the patient support platform (2) and are mounted for pivotal movement about a longitudinal pivot axis from a raised operative position supporting a patient to a lowered inoperative position. Each side member (30) is carried on a pair of spaced-apart cranked support arms (34, 35) which are bridged by a bridging bar (42) to form a frame. A primary retaining device retains the side support in the raised position. Each support arm (34, 35) is pivotally mounted to a pivot support sleeve which is slidably mounted on a round bar (46) forming a track. A secondary retaining device is provided by a stop disc (48) having a slot (50) which is moved into and out of alignment with a latch (47) to control movement of the sleeve (45) on the bar (46).

20 Claims, 7 Drawing Sheets

49
48a
47
48
43
41
46
44
45
37
36
102
55
100
38
40
42
51
65
50

THERAPEUTIC BED

BACKGROUND OF THE INVENTION

The present invention relates to therapeutic beds. More particularly, the invention relates to a therapeutic bed of the type comprising a base frame, a patient support platform rotatably supported by the base frame, and a pair of longitudinally extending side members for the patient support platform to support and retain a patient on the platform.

Therapeutic beds are used for patients who are rendered immobile by virtue of accident or disease and become victims of the serious complications of immobility such as urinary tract stone formation, pneumonia, atelectasis, venous thrombosis, decubitus, muscular wasting, bone decalcification and bed sores. In an effort to overcome these problems such therapeutic beds often have a patient support platform which is mounted for controlled oscillation within a bed frame relative to a bed support on which the bed frame is mounted. Generally speaking, such a bed has lateral supports for a patient lying on the platform which are provided by upstanding side members detachably secured to the platform.

One of the major problems associated with therapeutic beds is that the side members are difficult to detach, get in the way of the doctor and nurse trying to treat the patient and are in other ways cumbersome. It is known to have various arrangements for storing such side members when not in use. However, such known arrangements are not generally satisfactory.

In some cases the side members are adjustably mounted and require re-setting to accommodate a particular patient every time they are removed. Thus, there is a risk that they may be incorrectly reset with consequent discomfort to a patient, or more seriously, not correctly set to restrain a patient's movement correctly.

The present invention is directed towards providing an improved construction of hospital bed which will overcome these and other problems.

BRIEF SUMMARY OF THE INVENTION

The object of the invention is to provide a therapeutic bed with side members which may be readily locked in the raised position, moved from a raised to a lowered position and which, in the lowered position are positioned in a non-obstructing manner.

According to the invention there is provided a therapeutic bed comprising:

base frame, a patient support platform rotatably supported by the base frame, drive means for oscillating the patient support platform relative to the base frame, a pair of side members for the patient support platform to support and retain a patient on the platform, a support arm for each side member, pivot connection means between the support arm and the patient support platform, and the pivot connection means defining a pivot axis which extends substantially parallel to a longitudinal axis of the patient support platform, for pivotal movement of the side members from a raised operative position extending upwardly of the patient support platform to a lowered position in which the side members are swung away from the patient support platform, and retaining means to retain the side members in the raised operative position.

In one particularly preferred embodiment of the invention, the pivot connection means comprises a pivot support which is laterally and slidably movable transversely of the patient support platform from a first position in which the pivotal movement of the support arm is prevented by the retaining means to a second position in which the support arm may be freely pivoted.

Preferably the pivot support comprises a sleeve which is slidably mounted on a track.

In one embodiment of the invention the retaining means comprises:

primary retaining means which, in the raised position of the side member prevents pivotal movement of the support arm, and, a secondary retaining means which prevents movement of the pivot support between the first and second positions.

In one embodiment of the invention the primary retaining means is provided by inter-engagement between the support arm and the patient support platform in the raised position of the side member.

Preferably the secondary retaining means comprises a latch carried by the pivot support and a stop for the latch, the stop being movable from a locking position in which movement of the latch is prevented to a released position in which the latch is free to move.

In a preferred embodiment of the invention the stop includes a cut-out slot which is movable into and out of alignment with the latch.

Preferably the stop includes a cam surface for engaging the latch when the stop is being moved between the released and locked positions.

Ideally engagement means are provided for locking the stop in the locked position.

Preferably inter-lock means are provided to prevent movement of the patient support platform unless the side members are in the raised position.

In one embodiment of the invention the support arm is of cranked construction comprising a first portion which is pivotally connected beneath the patient support platform and projects outwardly below the patient support platform, and a second portion which projects above the patient support platform when the side member is in the raised position.

Preferably each side member is mounted on a pair of longitudinally spaced-apart support arms which are preferably interconnected to form a framework.

In one embodiment of the invention the side member is adjustably mounted to the support arm to vary the spacing between the side members above the patient support platform.

Preferably locking means are provided to lock the side member in a desired position relative to the support arm.

In one embodiment of the invention a portion of the patient support platform is pivotal relative to the rest of the platform to provide a height adjustable backrest.

In this case preferably means are provided to raise and lower the backrest automatically, said positioning of the backrest at greater than a predetermined angle to the rest of the patient support platform necessitating removal of the side members from the raised position and disconnection of the power supply to the motor.

The means for pivoting the backrest may comprise:

an actuator mounted below the patient support platform; and a lever arm pivotally connected to the actuator and lying between the backrest and the patient support platform.

A headrest is preferably formed from a pair of spaced-apart pillars on that portion of the patient support platform forming the backrest.

Typically a height adjustable head engaging rest is removably mounted on each pillar, the rests being laterally adjustable.

Preferably an abduction member is removably mounted on the patient support platform adjacent the foot of the bed and longitudinally adjustable on the patient support platform.

BRIEF DESCRIPTION OF THE DRAWINGS

The invention will be more clearly understood from the following description thereOf given by way of example only with reference to the accompanying drawings wherein.

DETAILED DESCRIPTION OF THE INVENTION

Figure 1:
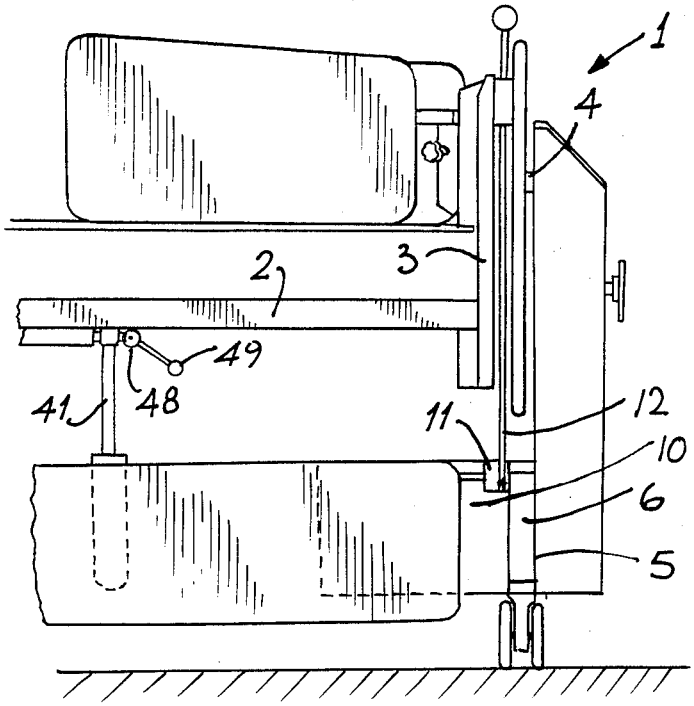
FIG. 1 is a side elevational view of a portion of a therapeutic bed according to the invention.
Figure 2:
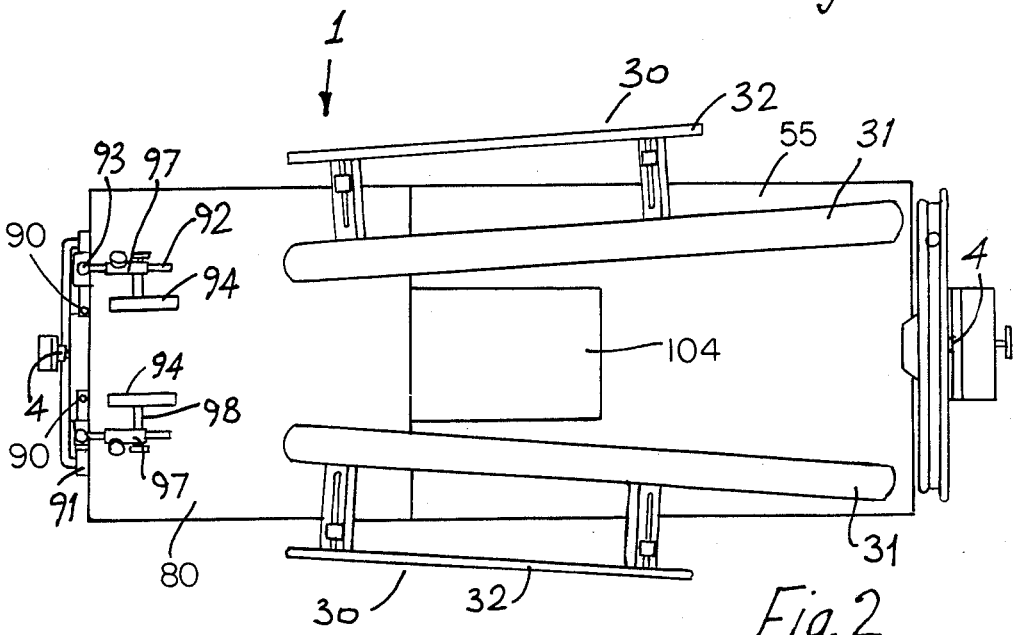
FIG. 2 is a top plan view of the bed of the invention.
Figure 3:
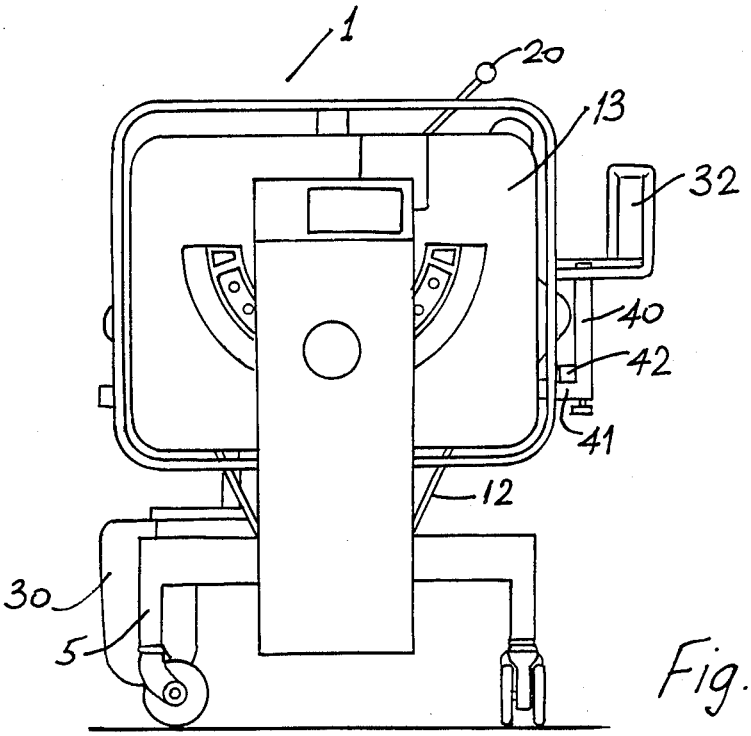
FIG. 3 is an end elevational view of the bed as viewed from the night of FIG. 1.
Figure 4:
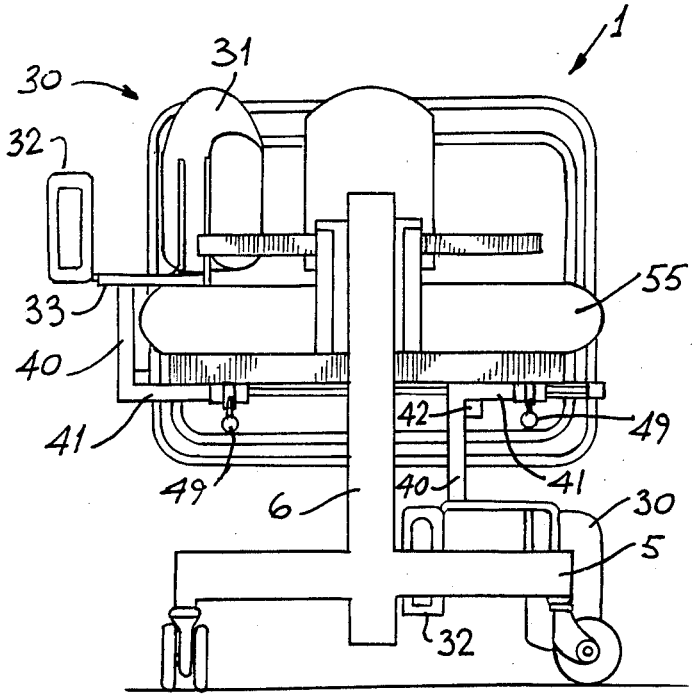
FIG. 4 is an opposite end elevational view of the bed with portion of the headrests removed for clarity.

Referring to the drawings there is illustrated a therapeutic bed indicated generally by the reference numeral 1 comprising a patient support platform 2 supported on a base frame 5. The patient support platform is rotatably and pivotally secured within a main bed frame 3 on pivot mountings 4 and the main bed frame 3 is supported on the base frame 5 by uprights 6. Oscillation of the therapeutic bed 1 is achieved by a motor 10 incorporating a gearbox, not shown. The motor 10 drives an output pulley 11 which in turn drives a belt 12 which engages an arcuate track (not shown) on the back of a footboard 13. The arcuate track is engaged with the drive belt 12 by means of a camming lever 20 which provides quick engagement and disengagement of the drive.

Figure 5:
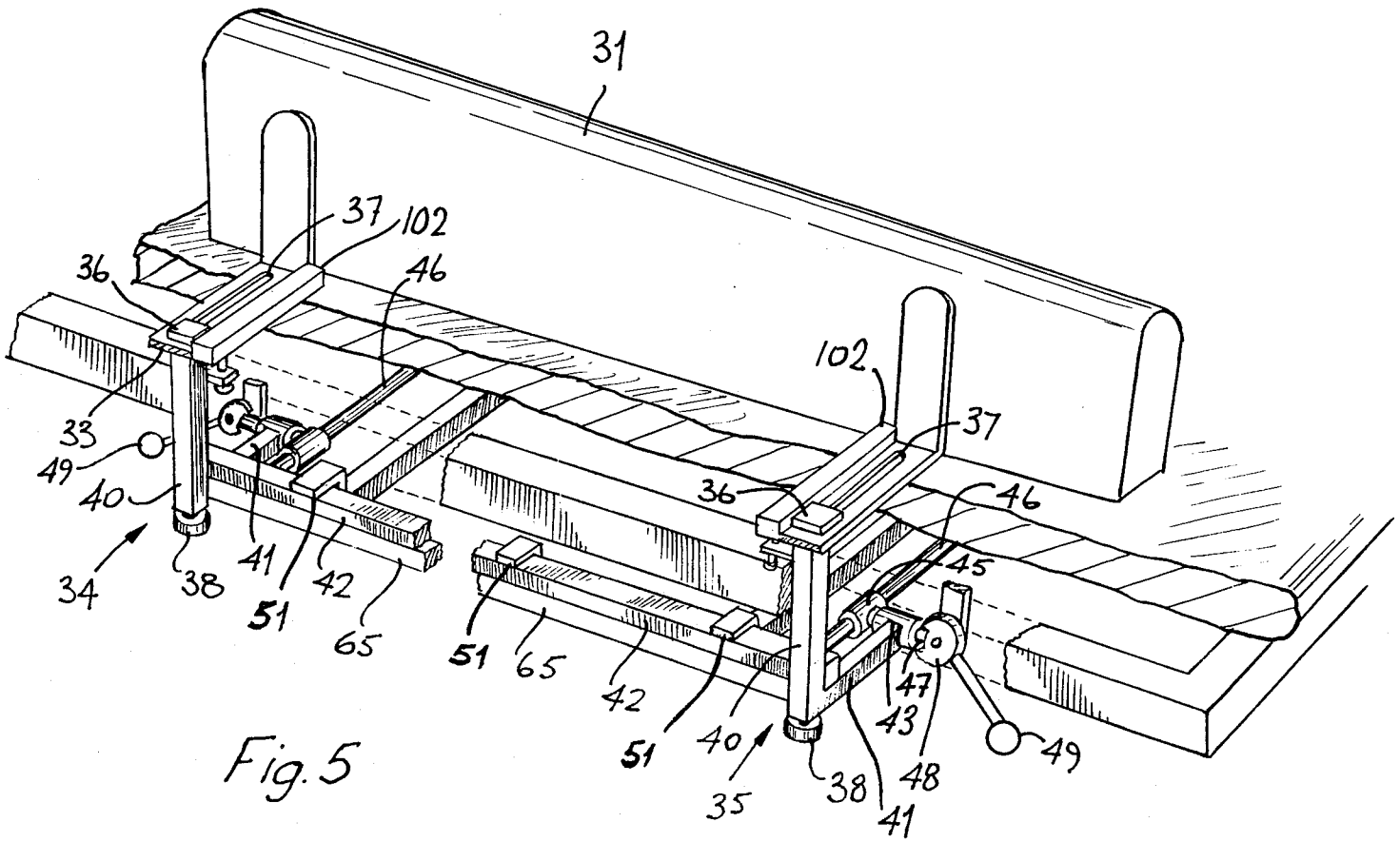
FIG. 5 is a perspective view of portion of the bed with a side member in a raised position.
Figures 6, 7, 8:
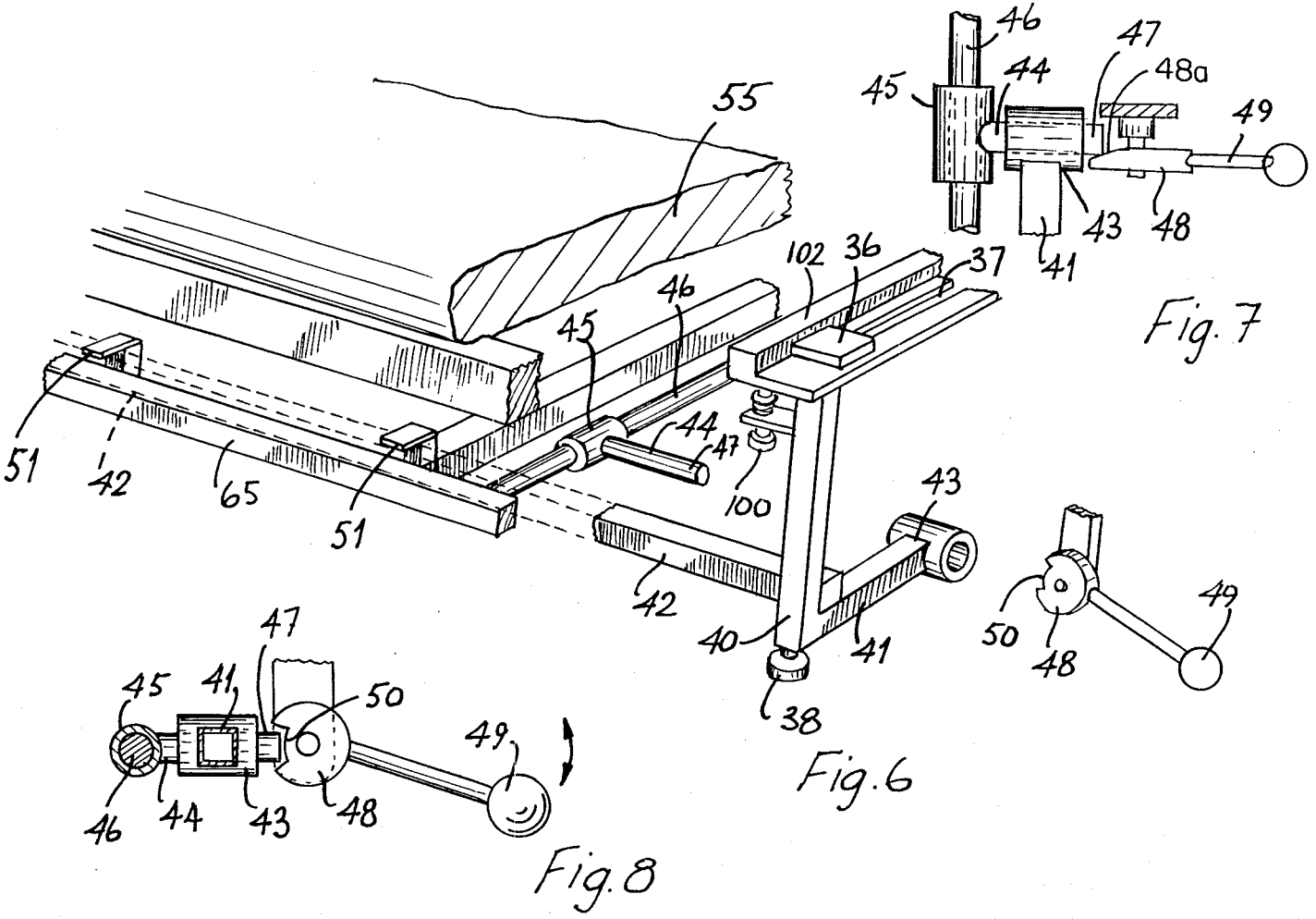
FIG. 6 is a perspective, partially exploded view of the portion of FIG. 5.
FIG. 7 is a plan view of a detail of the bed of FIG. 5.
FIG. 8 is a side view of the detail of FIG. 7.

A pair of side members indicated generally by the reference numeral 30 extend longitudinally of the patient support platform. Each of the side members 30 in this case comprise an inner padded portion 31 and an outer padded portion 32 bridged by a base 33 which would be padded for reception of a patient's arm. Each of the side members 30 are mounted on a pair of spaced-apart support arms 34, 35 and are laterally adjustable thereon by a pin 36 and slot 37 arrangement as illustrated in FIGS. 5 and 6. When the correct position of the side members 30 for a particular patient is set, the pin 36 is locked in position by a knob 38 which fixes the position of the side member 30. To ensure locking of the side members 31 in a desired position an additional locking means is provided comprising an index plunger 100 which is spring biased to engage one of a plurality of spaced-apart register holes provided in the underside of an additional bar 102. It will be noted that the side edge of the bar 102 also provides a stop to prevent turning of the squared head of the pin 36.

Figure 9:
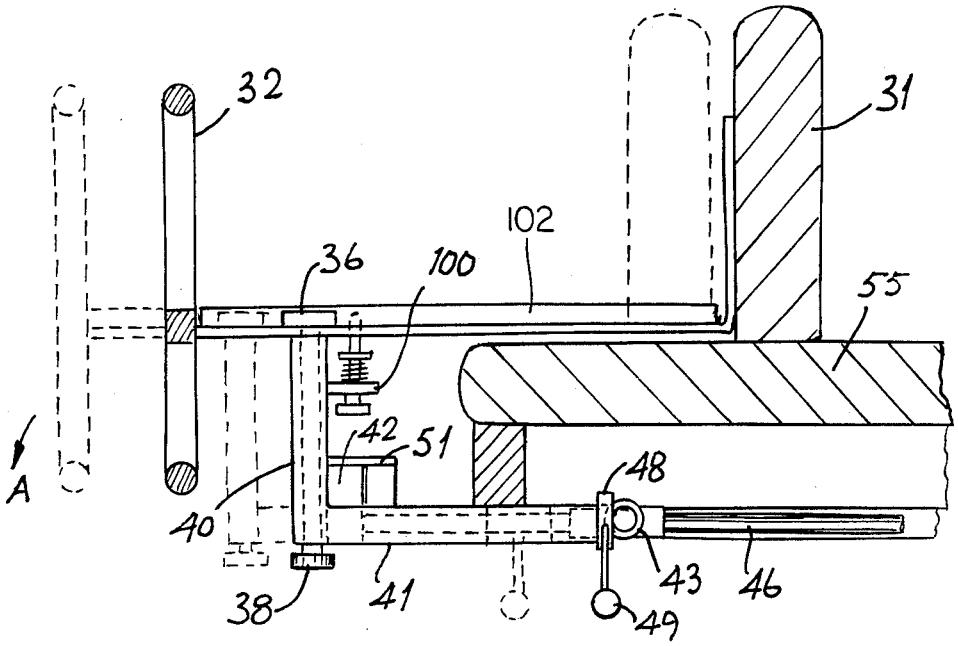
FIG. 9 is a cross-sectional view of a portion of the bed with a side member in a raised position.
Figure 10:
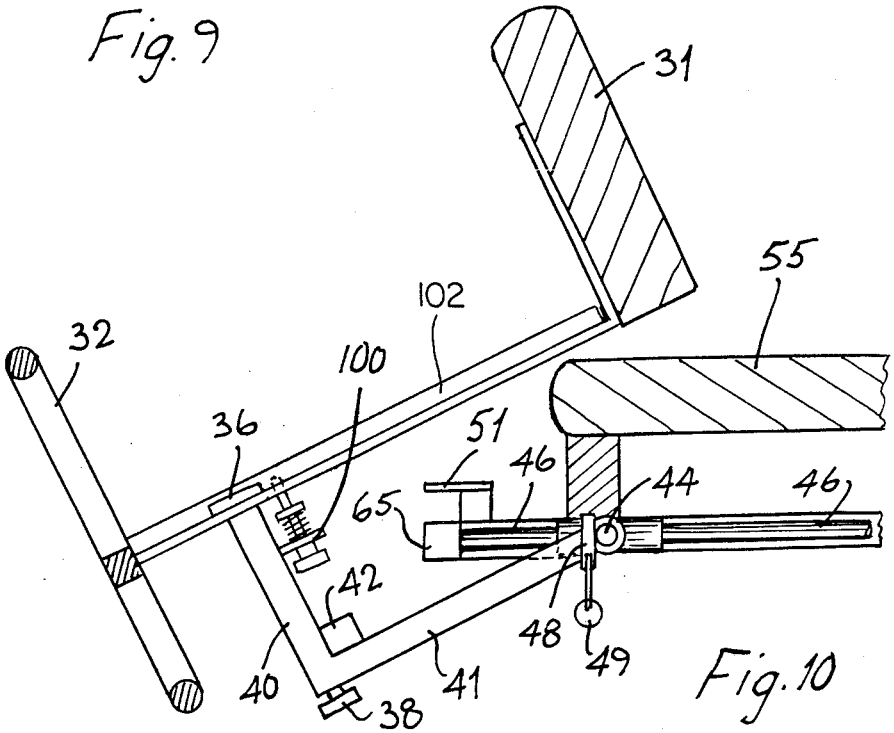
FIG. 10 is a cross-sectional view similar to FIG. 9 with the side member in an intermediate position.
Figure 11:
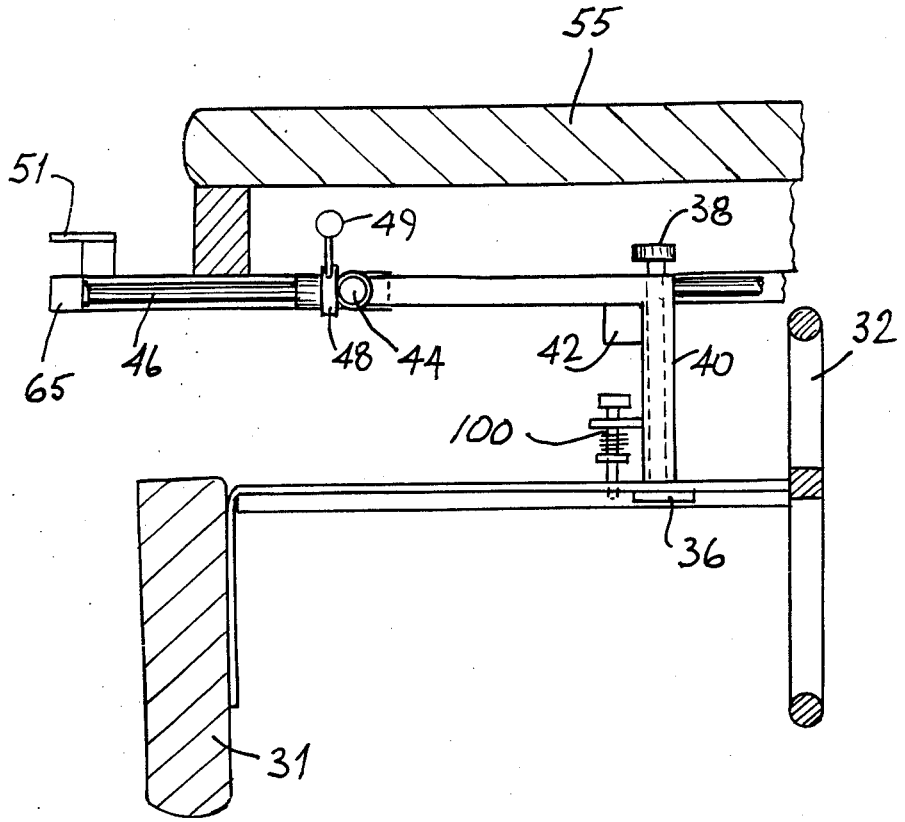
FIG. 11 is a cross-sectional view similar to FIG. 9 with the side member in a lowered position.

To facilitate movement of a patient onto and off the bed and to facilitate medical staff working on a patient who cannot move on the bed, at least one, and in this case both of the side members 30 are pivotally mounted for pivotal movement from a raised operative position as illustrated in FIG. 9 through an intermediate position illustrated in FIG. 10 to a lowered in-operative position as illustrated in FIG. 11.

Each of the support arms 34, 35 is of cranked construction, having an upper leg 40 and a base leg 41 and the support arms 34, 35 are bridged by a bridging bar 42 to form a frame. The base leg 41 is pivotally mounted at 43 on a pivot shaft 44 carried by a pivot support 45. As will be particularly apparent from FIG. 6 the pivot support 45 forms a sleeve which is laterally and slidably mounted on a track provided by a round bar 46 which forms part of the patient support platform.

The pivot shaft 44 includes an extension portion forming a latch 47 which engages with a stop formed by a disc 48 which is rotatably mounted to the patient support platform and is operated by a handle 49. The disc 48 includes a cut-out slot 50 which, when in alignment with the latch 47 allows the pivot support sleeve 45 to be freely moved on the round bar 46. The disc 48 also includes a cam surface **48*a* for ease of travel and locking of the latch pin 47 with the disc 48. Additional locking means which in this case comprises an electrical interlock (not shown) associated with the stop disc 48 prevents movement of the patient support platform unless the side members 30 are in the raised operative position. In addition, an index plunger (not shown) is preferably provided to engage with index holes in the disc 48 corresponding to the open and locked positions of the disc 48**.

Primary retaining means to prevent the support arms from being moved from the raised to the lowered position is provided by engagement between the bridging bar 42 and a cross bar 65 of the patient support platform when the side members are raised. It will be noted from FIG. 5 that the cross bar 65 is located below the bridging bar 42 and assists in supporting the bridging bar 42 and hence the side members when the side members are in the raised position. To further confine the support arms in the raised position additional flange portions 51 are provided which define, together with the cross bar 65 a channel for closely confining the bridging bar 42 of the side members.

In use, the stop disc 48 acts as a secondary retaining means which prevents the pivot support sleeve 45 from sliding outwardly on the round bar 46 and hence prevents the bridging bar 42 of the support arms from disengaging the cross bar 65. When the disc 48 is released by operating handle 49 latch 47 is aligned with the slot 50 allowing latch 47 and hence the pivot support sleeve 45 to slide outwardly on the bar 46. This allows the bridging bar 42 of the support arms to disengage from the cross bar 65 which in turn allows the support arms to pivot outwardly in the direction of the arrow A in FIG. 9 to the lower inoperative position illustrated in FIG. 10.

Figure 12:
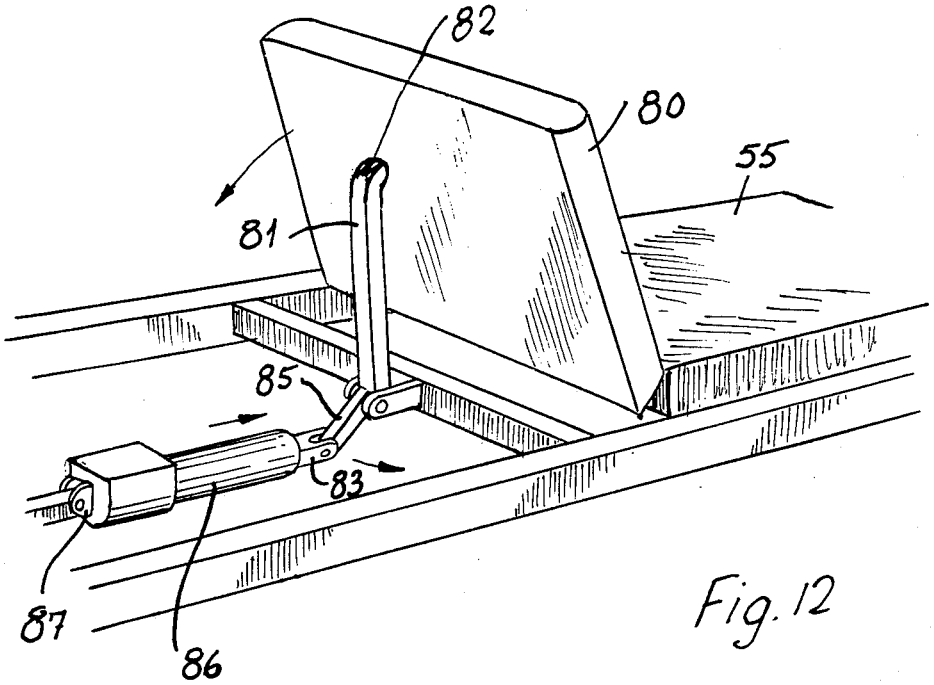
FIG. 12 is a perspective view of a backrest portion of the bed.

Referring particularly to FIG. 12 the patient support platform 2 carries a mattress 55. Portion 80 of the patient support platform 2 is pivotal upwards to form a backrest. Beneath the portion 80 is a lever arm 81 having a roller 82 at its outer end which engages beneath the backrest 80 and is in turn connected to a piston 83 by a con rod 85. The piston forms part of an electric actuator 86 which is mounted by a bracket 87 to the patient support platform 2. In the reclining position the piston of the actuator is fully extended. When it is desired to use the back rest 80 the side members 30 are pivoted downwards and out of the way, thus disconnecting the motor 10 and the piston is retracted within the ram 86, thus causing the lever arm to pivot up, raising the backrest 80. Separate side rails are preferably provided to retain a patient when the backrest is raised.

Figure 13:
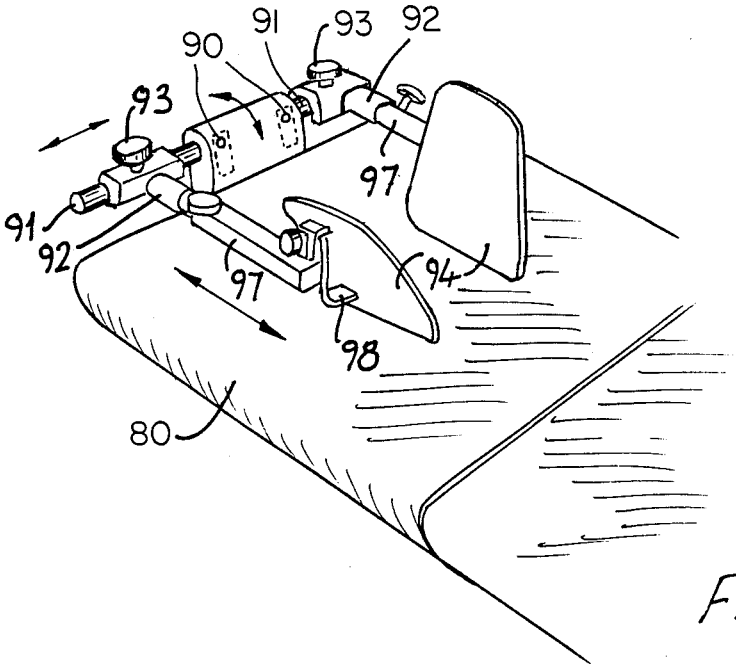
FIG. 13 is a perspective view of a headrest portion of the bed.

Referring particularly to FIG. 13, mounted on the patient support platform 2, in fact on the backrest 80 thereof, there are two spaced-apart pillars 90, each supporting a cross bar 91 which in turn slidably supports a cantilevered arm 92 which is secured in position by a knob 93. Each arm 92 supports a headrest 94, which is mounted thereon by a sleeve 97 and a further arm 98. Thus the headrest 94 can be adjusted both laterally and longitudinally relative to the patient support platform.

An abduction member 104 is removably mounted on the patient support platform 2 adjacent the foot of the bed and is longitudinally adjustable on the patient support platform 2.

One advantage of the invention is in providing a configuration of side members for a therapeutic bed which are readily set to the correct position to support a patient and which may be readily swung out of the way to a non-obstructing position when a nurse or doctor requires to work on a patient. When lowered, the side members do not project outwardly beyond the outer periphery of the side of the bed. Once the correct position for the side members is set they remain set even when they are moved from the raised to the lowered position a number of times. This is of particular importance as if the side members had to be set every time they were lowered and raised not only would it be time consuming and cumbersome but more importantly the chances of incorrect setting occurring are greatly increased.

It will be appreciated that in some cases the patient support platform may not be mounted to allow raising and lowering relative to the base frame.

I claim:

1. A therapeutic bed comprising:

a base frame;

a patient support platform rotatably supported by said base frame;

drive means for oscillating said patient support platform relative to said base frame;

a pair of side members for said patient support platform to support and retain a patient on said platform;

a support arm for each side member, pivot support means between each support arm and said patient support platform for pivotal movement of said side members from a raised operative position extending upwardly of said patient support platform to a lowered position in which said side members are swung away from said patient support platform, each pivot support means defining a pivot axis extending substantially parallel to a longitudinal axis of said patient support platform; and retaining means for retaining said side members in the raised operative position, said pivot support means being movable transversely of said patient support platform from a first position in which the pivotal movement of said support arm is prevented by said retaining means to a second position in which said support arm is freely pivotable to said lowered position.

2. A therapeutic bed as claimed in claim 1 wherein said pivot support means comprises a track means mounted on said patient support platform and a sleeve slidably mounted on said track means.

3. A therapeutic bed as claimed in claim 1 wherein said retaining means comprises:

a primary retaining means which, in the raised position of said side member prevents pivotal movement of said support arm, and, a secondary retaining means which prevents movement of said pivot support means between said first and second positions.

4. A therapeutic bed as claimed in claim 1 wherein said support arm is of cranked construction comprising a base leg pivotally connected to said pivot support means beneath said patient support platform and projects outwardly below said patient support platform, and an upper leg which projects above said patient support platform when said side member is in the raised position.

5. A therapeutic bed as claimed in claim 4 wherein each side member is mounted on a pair of said support arms longitudinally spaced apart which are interconnected to form a framework.

6. A therapeutic bed as claimed in claim 1 wherein each side member is adjustably mounted to a respective support arm to alter the position of said side members to suit a particular patient.

7. A therapeutic bed as claimed in claim 6 wherein locking means are provided to lock each side member in a desired position relative to said support arm.

8. A therapeutic bed as claimed in claim 1 wherein a portion of said patient support platform is pivotal relative to the rest of said platform to provide height adjustable backrest.

9. A therapeutic bed as claimed in claim 8 wherein means are provided to raise and lower said backrest automatically, positioning of the backrest at greater than a predetermined angle to the rest of the patient support platform necessitating removal of said side members from the raised position and disconnection of a power supply to said drive means.

10. A therapeutic bed as claimed in claim 9 wherein said means for raising and towering said backrest comprises:

an actuator mounted below said patient support platform; and a lever arm pivotally connected to said actuator and lying between said backrest and said patient support platform.

11. A therapeutic bed as claimed in claim 9 wherein a headrest means is provided comprising a pair of spaced-apart pillars mounted on said backrest.

12. A therapeutic bed as claimed in claim 11 wherein said headrest means further comprises an adjustable head engaging rest removably mounted on each pillar, and means between each pillar and head engaging rest for adjusting said head engaging rest laterally and longitudinally relative to said patient support platform.

13. A therapeutic bed as claimed in claim 1 wherein an abduction member is removably mounted on said patient support platform adjacent the foot of the bed and is longitudinally adjustable on said patient support platform.

14. A therapeutic bed comprising:

a base frame;

a patient support platform rotatably supported by said base frame;

drive means for oscillating said patient support platform relative to said base frame;

a pair of side members for said patient support platform to support and retain a patient on said platform;

a support arm for each side member;

pivot connection means between each support arm and said patient support platform for pivotal movement of said side members from a raised operative position extending upwardly of said patient support platform to a lowered position in which said side members are swung away from said patient support platform, each pivot connection means being movable transversely with respect to said patient support platform and defining a pivot axis which extends substantially parallel to a longitudinal axis of said patient support platform;

retaining means for retaining said side members in the raised operative position; and an adjustable backrest comprising a portion of said patient support platform pivotally mounted for pivotal movement relative to the remainder of said patient support platform and power means mounted below said pivotally mounted portion and operatively engaging with said pivotally mounted portion for pivoting said pivotally mounted portion when actuated.

15. A therapeutic bed comprising:

a base frame;

a patient support platform rotatably supported by said base frame;

drive means for oscillating said patient support platform relative to said base frame;

a pair of side members for said patient support platform to support and retain a patient on said platform;

a support arm for each side member;

pivot connection means between each support arm and said patient support platform for pivotal movement of said side members from a raised operative position extending upwardly of said patient support platform to a lowered position in which said side members are swung away from said patient support platform, each pivot connection means defining a pivot axis which extends substantially parallel to a longitudinal axis of said patient support platform and comprising a pivot support laterally and slidably movable transversely of said patient support platform from a first position in which pivotal movement of a respective support arm is prevented to a second position in which the respective support arm is freely pivotable; and retaining means for retaining said side members in the raised operative position comprising primary retaining means provided by interengagement between said respective support arm and said patient support platform in the raised position of said respective side member for preventing pivotal movement of said respective support arm, and secondary retaining means for preventing movement of said pivot support between said first and second positions.

16. A therapeutic bed comprising:

a base frame;

a patient support platform rotatably supported by said base frame;

drive means for oscillating said patient support platform relative to said base frame;

a pair of side members for said patient support platform to support and retain a patient on said platform;

a support arm for each side member;

pivot connection means between each support arm and said patient support platform for pivotal movement of said side members from a raised operative position extending upwardly of said patient support platform to a lowered position in which said side members are swung away from said patient support platform, each pivot connection means defining a pivot axis which extends substantially parallel to a longitudinal axis of said patient support platform and comprising a pivot support laterally and slidably movable transversely of said patient support platform from a first position in which pivotal movement of a respective support arm is prevented to a second position in which the respective support arm is freely pivotable; and retaining means for retaining said side members in the raised operative position comprising primary retaining means for preventing pivotal movement of said respective support arm in the raised portion of said respective side member, and secondary retaining means for preventing movement of said pivot support between said first and second positions comprising a latch and a step for said latch, said step being movable from a locking position in which movement of said latch is prevented to a released position in which said latch is free to move.

17. A therapeutic bed as claimed in claim 16 wherein said stop includes a cut-out slot which is movable into and out of alignment with said latch.

18. A therapeutic bed as claimed in claim 17 wherein said stop includes a cam surface for engaging said latch when said stop is being moved between said released and out of alignment with said latch.

19. A therapeutic bed as claimed in claim 16 wherein engagement means are provided for locking said stop in the locked position.

20. A therapeutic bed as claimed in claim 19 wherein inter-lock means are provided to prevent movement of said patient support platform unless said side members are in the raised position.

* * * * *